US011031733B2

(12) United States Patent
Takeuchi et al.

(10) Patent No.: US 11,031,733 B2
(45) Date of Patent: Jun. 8, 2021

(54) TERMINAL FITTING

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Shunya Takeuchi, Mie (JP); Yasuo Omori, Mie (JP); Tetsuya Miyamura, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 511 days.

(21) Appl. No.: 16/074,101

(22) PCT Filed: Jan. 24, 2017

(86) PCT No.: PCT/JP2017/002246
§ 371 (c)(1),
(2) Date: Jul. 31, 2018

(87) PCT Pub. No.: WO2017/138348
PCT Pub. Date: Aug. 17, 2017

(65) Prior Publication Data

US 2021/0104841 A1 Apr. 8, 2021

(30) Foreign Application Priority Data

Feb. 11, 2016 (JP) ..... JP2016-024228

(51) Int. Cl.
*H01R 13/642* (2006.01)
*H01R 13/422* (2006.01)
(Continued)

(52) U.S. Cl.
CPC ..... *H01R 13/642* (2013.01); *H01R 13/4226* (2013.01); *H01R 4/185* (2013.01); *H01R 13/11* (2013.01)

(58) Field of Classification Search
CPC .. H01R 4/185; H01R 13/642; H01R 13/4226; H01R 13/11; H01R 13/6456
See application file for complete search history.

(56) References Cited

U.S. PATENT DOCUMENTS 6,729,904 B2 * 5/2004 Nankou ..... H01R 13/113 439/595
2005/0227551 A1 10/2005 Tabata et al.
(Continued)

FOREIGN PATENT DOCUMENTS

| | | |
|---|---|---|
| JP | 4-220970 | 8/1992 |
| JP | 2005-302573 | 10/2005 |
| JP | 5831611 | 12/2015 |

OTHER PUBLICATIONS

International Search Report dated Apr. 25, 2017.

*Primary Examiner* — Briggitte R. Hammond
(74) *Attorney, Agent, or Firm* — Gerald E. Hespos; Michael J. Porco; Matthew T. Hespos

(57) ABSTRACT

It is aimed to reliably prevent inverted insertion of a terminal fitting. Oblique insertion restricting portions (27, 28) recessed while extending in a direction intersecting an inserting direction of a terminal fitting (T) into a connector housing (1) and capable of restricting the insertion of a rectangular tube portion (10) by a material of an inner wall of a cavity (4) biting into the oblique insertion restricting portions when the terminal fitting (T) is inserted in an orientation inverted from a proper posture and in an oblique posture into the cavity (4) are provided on corner parts of the rectangular tube portion (10).

6 Claims, 9 Drawing Sheets

(51) Int. Cl.
*H01R 13/11* (2006.01)
*H01R 4/18* (2006.01)

(56) References Cited

U.S. PATENT DOCUMENTS

2007/0123093 A1* 5/2007 Lutsch ..... H01R 13/4223
439/445
2016/0087353 A1 3/2016 Endo

* cited by examiner

TERMINAL FITTING

BACKGROUND

Field of the Invention

The invention relates to a terminal fitting.

Related Art

Japanese Unexamined Patent Publication No. 2005-302573 discloses a female terminal fitting with a stabilizer preventing inverted insertion. The stabilizer of a female terminal fitting that is in a proper orientation will be inserted into an escaping groove in a cavity of a connector housing, thereby allowing the insertion of the terminal fitting. However, if the terminal fitting is in an inverted orientation by mistake, the stabilizer interferes with the connector housing to prohibit the insertion of the terminal fitting into the cavity.

However, a worker could attempt to insert a terminal fitting in an inverted and oblique posture, i.e. where the terminal fitting is in an inverted posture diagonally facing an entrance of the cavity. In this situation, a stabilizer, which is a most projecting part from the terminal fitting, is located substantially on a diagonal of a cavity. Thus, the stabilizer and the cavity interfere with each other to a small extent, and there has been a concern that the terminal fitting is inserted forcibly while pushing and widening an inner wall near the entrance of the cavity.

The invention was completed on the basis of the above situation and aims to provide a terminal fitting capable of effectively avoiding inverted insertion of a terminal fitting.

SUMMARY

The invention is directed to a terminal fitting with a rectangular tube and a stabilizer for preventing inverted insertion projecting on an outer surface of the rectangular tube. The terminal can be inserted into a cavity formed in a connector housing when the terminal fitting is facing the cavity in a proper posture. However, insertion of the terminal fitting is prohibited by the stabilizer interfering with the connector housing when the terminal fitting is facing the cavity in a posture inverted from the proper posture. An oblique insertion restricting portion is recessed on a corner of the rectangular tube while extending in a direction intersecting an inserting direction of the terminal fitting into the connector housing. The oblique insertion restricting portion is capable of restricting the insertion of the rectangular tube by a material of an inner wall of the cavity biting into the oblique insertion restricting portion when the terminal fitting is inserted into the cavity in an orientation inverted from the proper posture and in an oblique posture.

An attempt could be made to insert the terminal fitting forcibly into the cavity of the connector housing in a state where the terminal fitting is obliquely facing the cavity in an inverted posture. In this situation, corner parts of the conventional rectangular tube may forcibly push and widen the inner wall of the cavity to allow insertion. However, according to the present invention, even if the terminal fitting is inserted into the cavity in an inverted orientation and in an oblique posture, the material of the inner wall of the cavity bites into the oblique insertion restricting portion formed on the corner of the terminal fitting, thereby restricting improper insertion of the terminal fitting.

The oblique insertion restricting portion may be disposed on the corner located on at least one diagonal position of the rectangular tube. According to this configuration, when the terminal fitting is inserted in an inverted orientation into the cavity, the material of the cavity bites into the oblique insertion restricting portion located at the diagonal position to be caught, depending on a direction of inclination. Thus, improper insertion can be restricted more reliably.

The oblique insertion restricting portions may be disposed on corners on both widthwise sides in the rectangular tube. According to this configuration, improper insertion of the terminal fitting can be restricted regardless of whether the direction of inclination of the terminal fitting with respect to the cavity is a clockwise direction or a counterclockwise direction.

The oblique insertion restricting portion may include a resilient piece cantilevered in a direction intersecting the inserting direction of the terminal fitting and may be deflectable inward of the rectangular tube by forming a substantially U-shaped slit penetrating through a wall of the rectangular tube. According to this configuration, when the terminal fitting is inserted in an inverted orientation into the cavity, the material of the inner wall of the cavity pushes the resilient piece inward of the rectangular tube. This enables the material of the inner wall of the cavity to bite into the oblique insertion restricting portion in a wider range, as compared to the case where a slit is merely provided in the rectangular tube by recessing. Therefore, improper insertion can be restricted more reliably.

The oblique insertion restricting portion may include a plurality of the resilient pieces along the inserting direction, and extending directions of the resilient pieces adjacent in the inserting direction may be mutually opposite directions. According to this configuration, even if an angle of inclination of the terminal fitting at the time of inverted insertion varies, the resilient pieces are deflected in a wider range by the material of the inner wall of the cavity since adjacent resilient pieces of the oblique insertion restricting portion extend in opposite directions. Thus, even if the angle of inclination of the terminal fitting at the time of inverted insertion varies, improper insertion can be restricted reliably.

An outer surface of the oblique insertion restricting portion and an outer surface of the rectangular tube around the oblique insertion restricting portion may be substantially flush with each other. According to this configuration, the oblique insertion restricting portion is substantially flush with the outer surface of the rectangular tube. Thus, insertion resistance when the terminal fitting is inserted properly need not be increased.

DETAILED DESCRIPTION

First and second embodiments of a terminal fitting of the invention are described below with reference to the drawings.

First Embodiment (Connector Housing 1)

Figure 4:
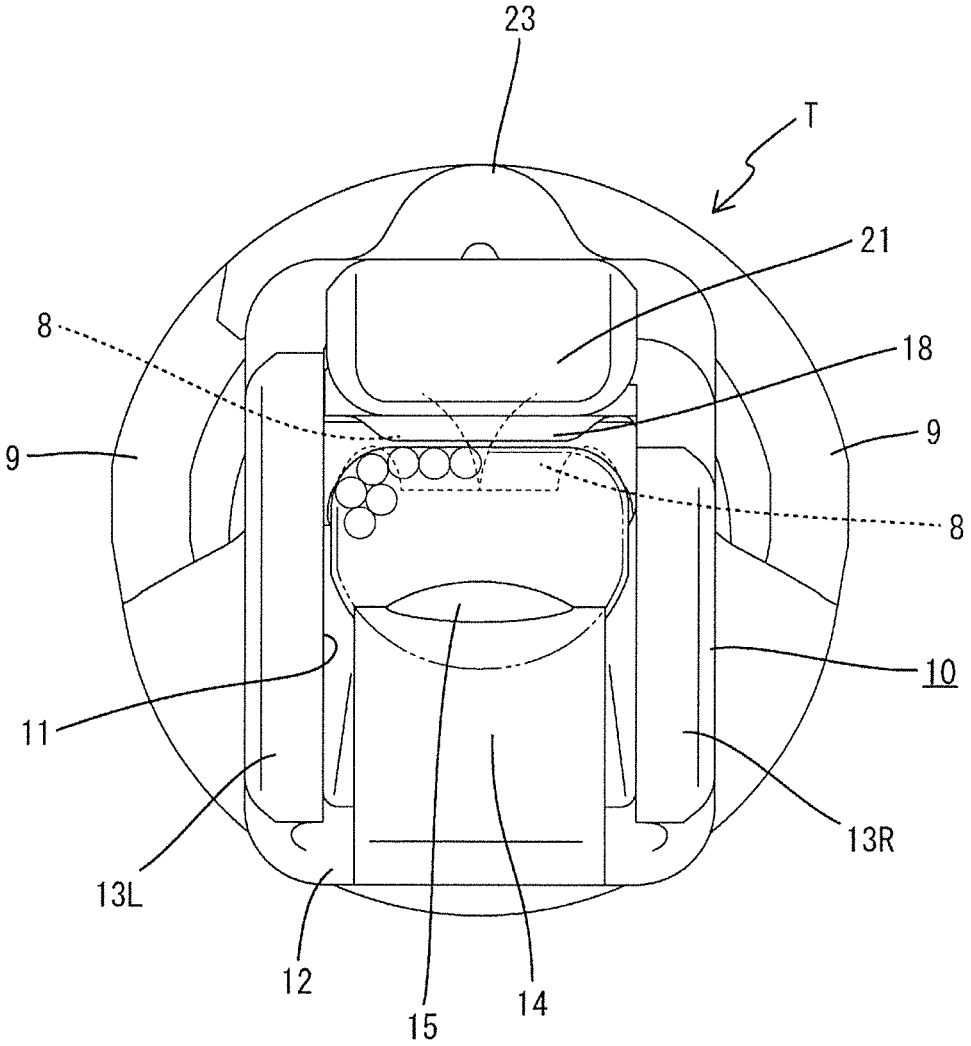
FIG. 4 is a front view of the terminal fitting.
Figure 5:
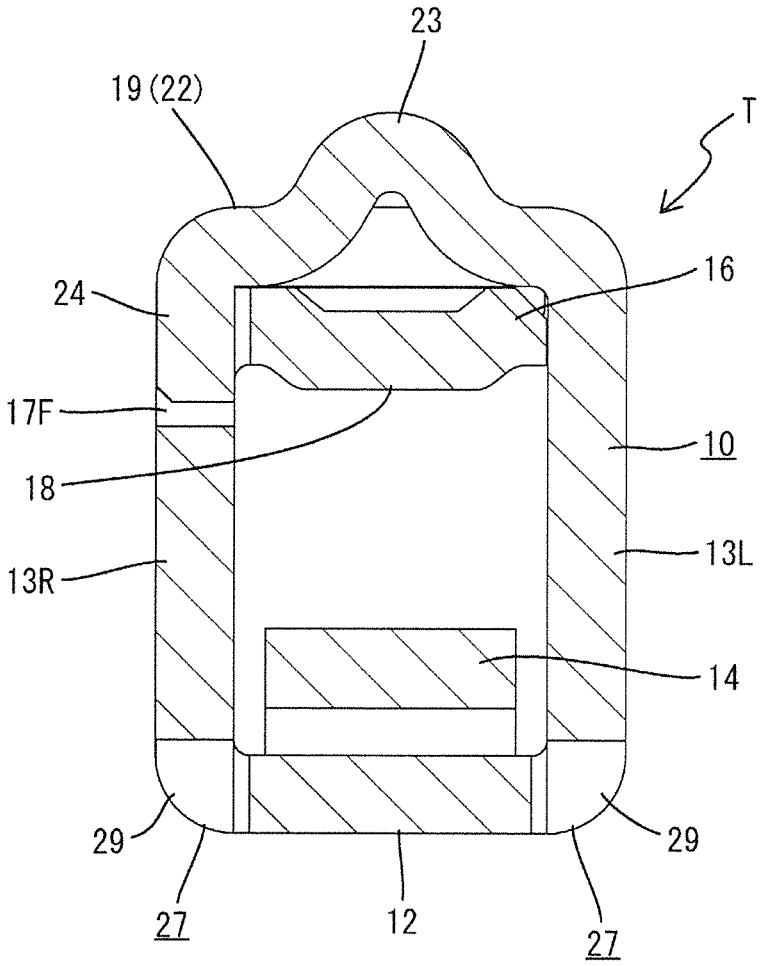
FIG. 5 is a section along A-A of FIG. 3.
Figure 6:
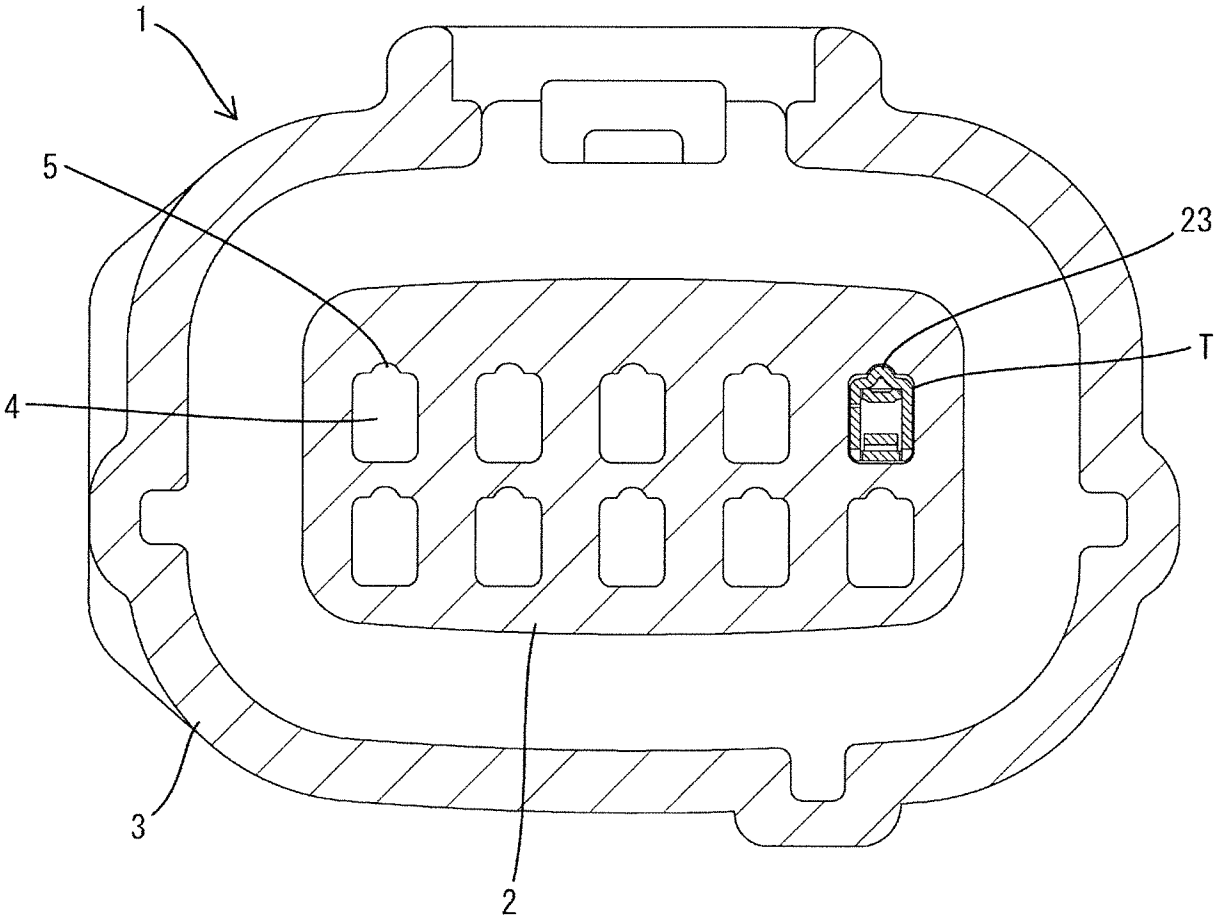
FIG. 6 is a front view in section of a connector showing a state where the terminal fitting is accommodated in a proper orientation in a cavity.

FIGS. 1 to 8 show the first embodiment of the invention. First, a connector housing 1 for accommodating terminal fittings T according to the first embodiment is described. As shown in FIG. 6, the connector housing 1 is composed of a terminal accommodating portion 2 for accommodating the terminal fittings T and a receptacle 3 surrounding the terminal accommodating portion 2. Cavities 4 for accommodating the terminal fittings T are provided in upper and lower stages in the terminal accommodating portion 2.

Figure 7:
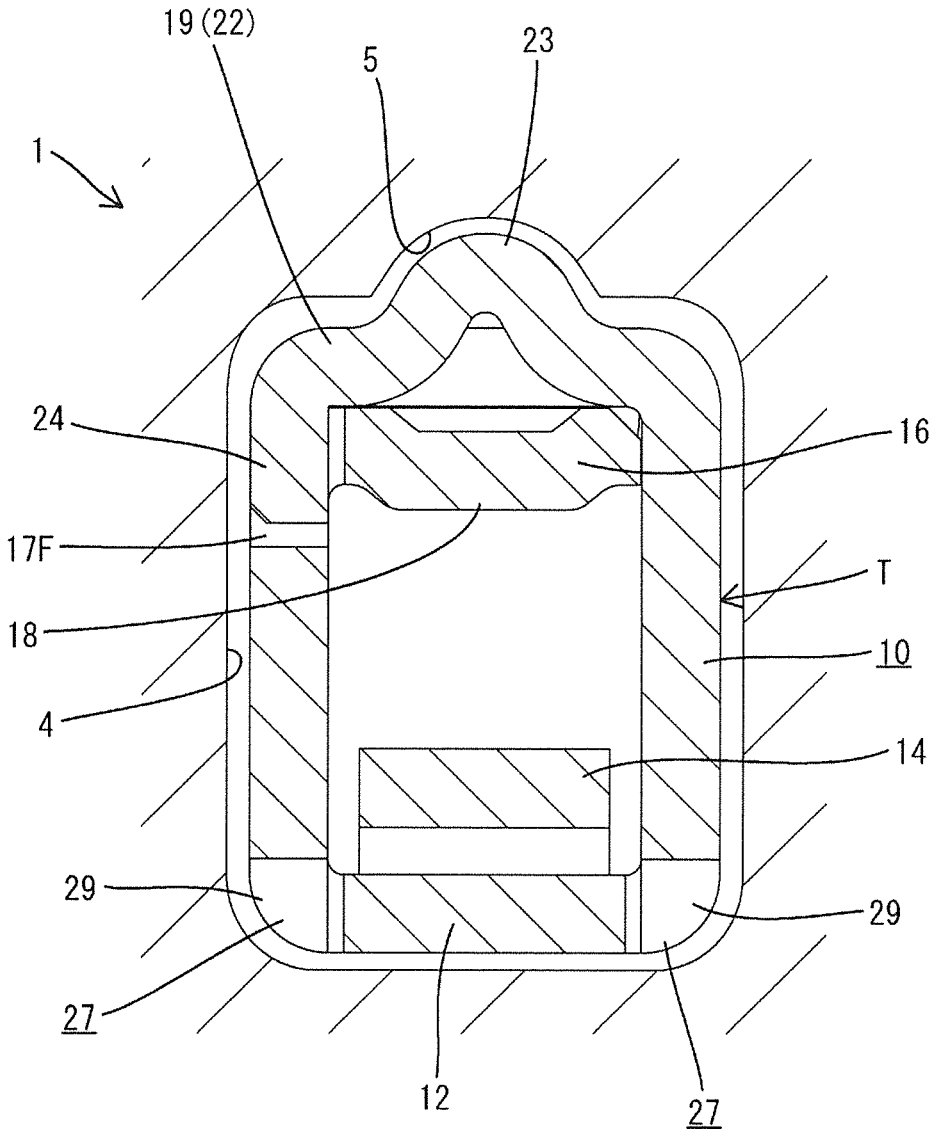
FIG. 7 is a section enlargedly showing a state where the terminal fitting is accommodated in the proper orientation in the cavity.
Figure 8:
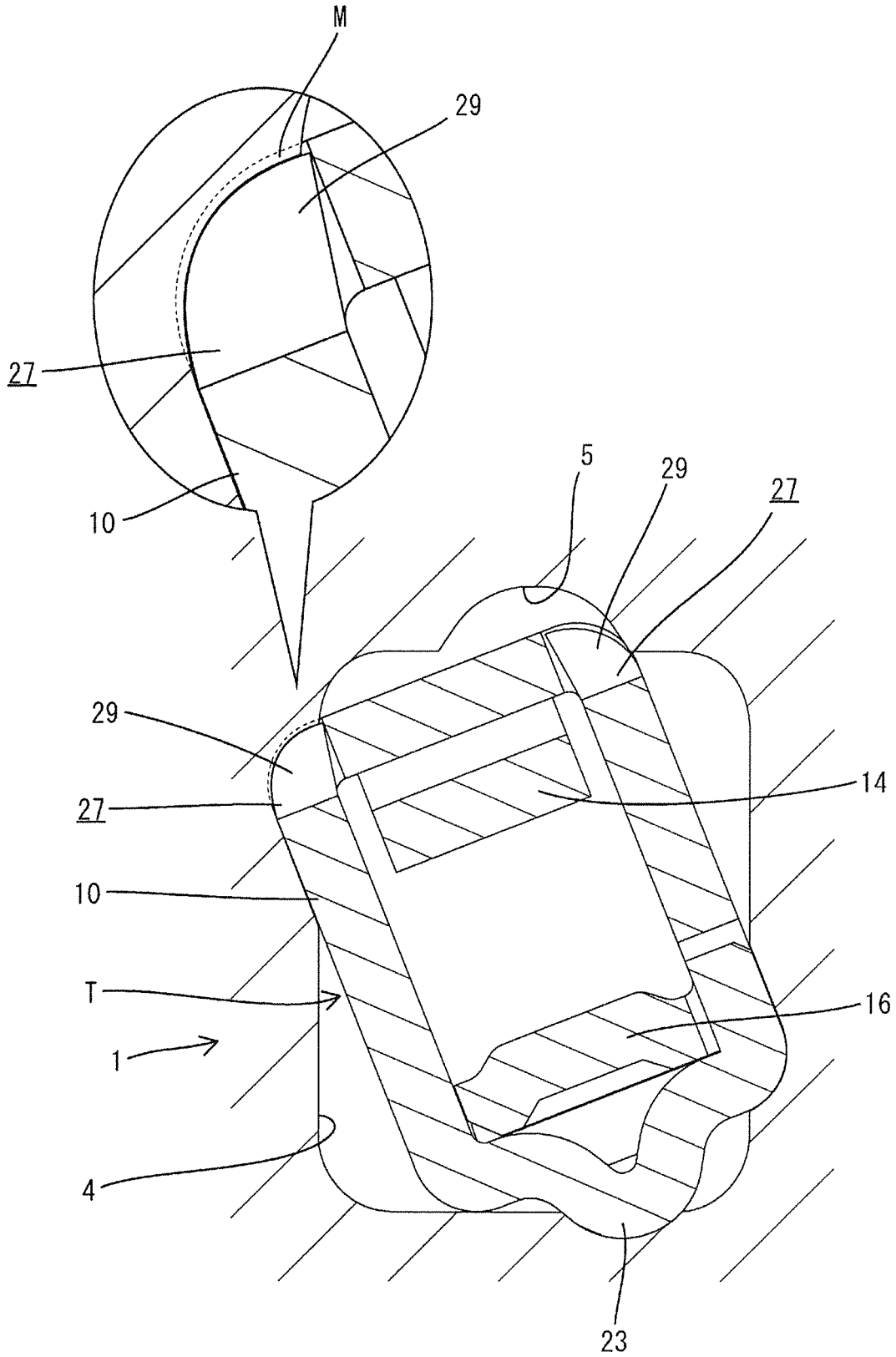
FIG. 8 is a section enlargedly showing a state where the terminal fitting is obliquely inserted in an inverted orientation into the cavity.

Each terminal fitting T is inserted into each cavity 4 from behind. As shown in FIGS. 7 and 8, each cavity 4 has a substantially rectangular cross-section long in a vertical direction and short in a width direction.

Each cavity 4 has a guide groove 5 recessed substantially over the entire length from an entrance of the cavity 4 and allows the insertion of stabilizers 23, 26 to be described later while guiding the stabilizers 23, 26 when the terminal fitting T is facing the cavity 4 in a proper orientation. However, if the terminal fitting T is facing the cavity 4 in a vertically inverted orientation, the stabilizers 23, 26 interfere with a wall surface around the entrance of the cavity 4, thereby prohibiting inverted insertion. The guide groove 5 is located in a widthwise central part on the ceiling surface of the cavity 4.

(Terminal Fitting T)

Next, the terminal fitting T is described. In the following description, a "front-rear direction" is based on that shown in FIG. 2 and a "vertical direction" and a "lateral direction" are based on those shown in FIG. 4.

Figure 1:
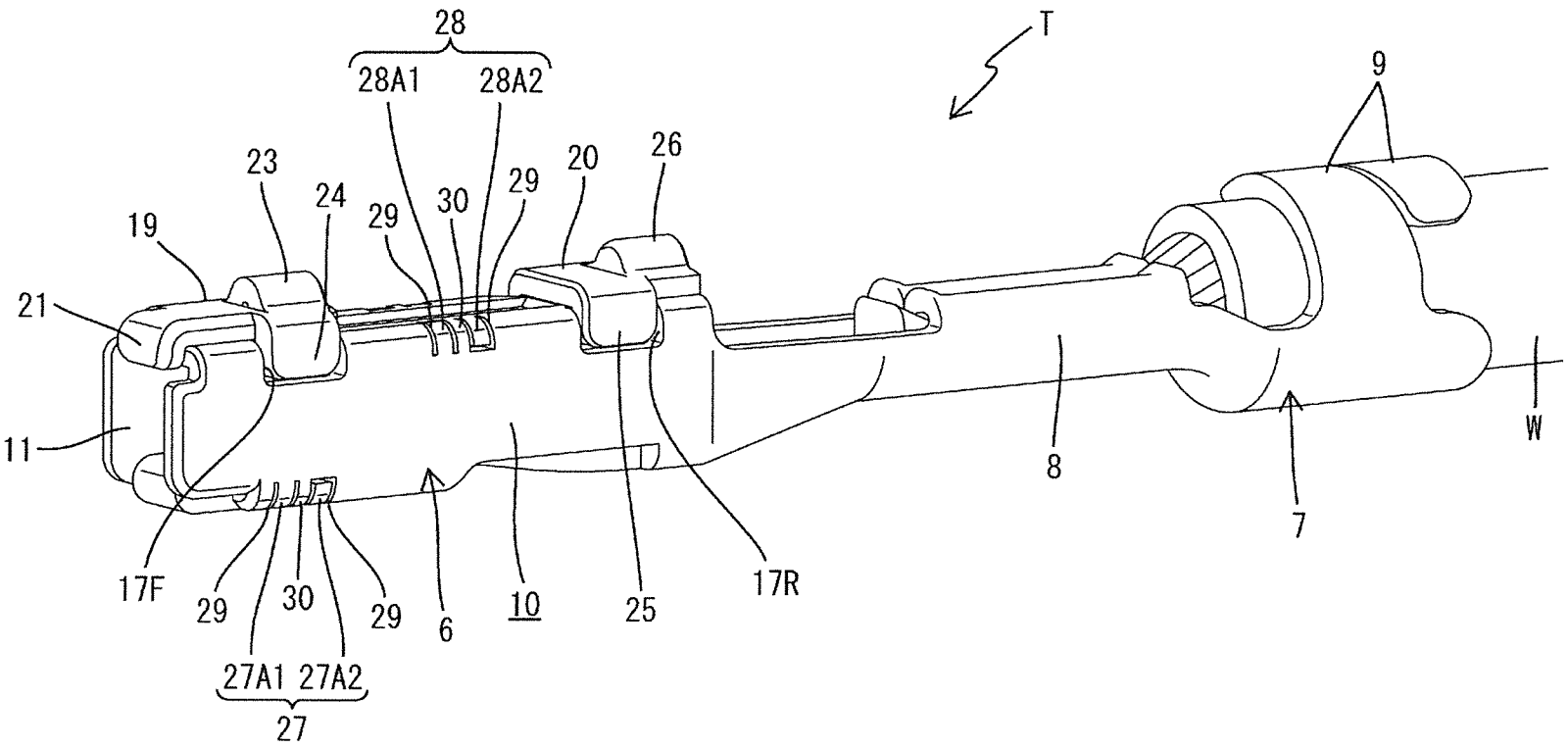
FIG. 1 is a perspective view of a terminal fitting according to a first embodiment.

The terminal fitting T according to the first embodiment is a female terminal fitting T formed of a thin plate material made of conductive metal. As shown in FIG. 1, the terminal fitting T includes a terminal connecting portion 6 for connection to a mating male terminal fitting on a front end and a wire connecting portion 7 to be connected to an end part of a wire W on a rear end. The wire connecting portion 7 is composed of a wire barrel 8 to be crimped to a core exposed at an end of the wire and an insulation barrel 9 to be crimped to a coating of the wire.

The terminal connecting portion 6 includes a rectangular tube 10 that is open in the front-rear direction. A front opening serves as a tab insertion opening 11 through which a tab of the mating terminal fitting is inserted. The rectangular tube 10 has a substantially rectangular shape long in the vertical direction and can be fit and inserted into the cavity 4.

As shown in FIGS. 4 and 5, the rectangular tube 10 includes a bottom wall 12 continuous from a bottom surface of the wire connecting portion 7, and two side walls 13R, 13L rising from both lateral sides of the bottom wall 12.

A resilient tongue 14 is folded back into the rectangular tube 10 from a front part of the bottom wall 12. The resilient tongue 14 can be deflected in the vertical direction, and a movable contact point 15 is formed on a top part to project up by being struck from below.

Figure 2:
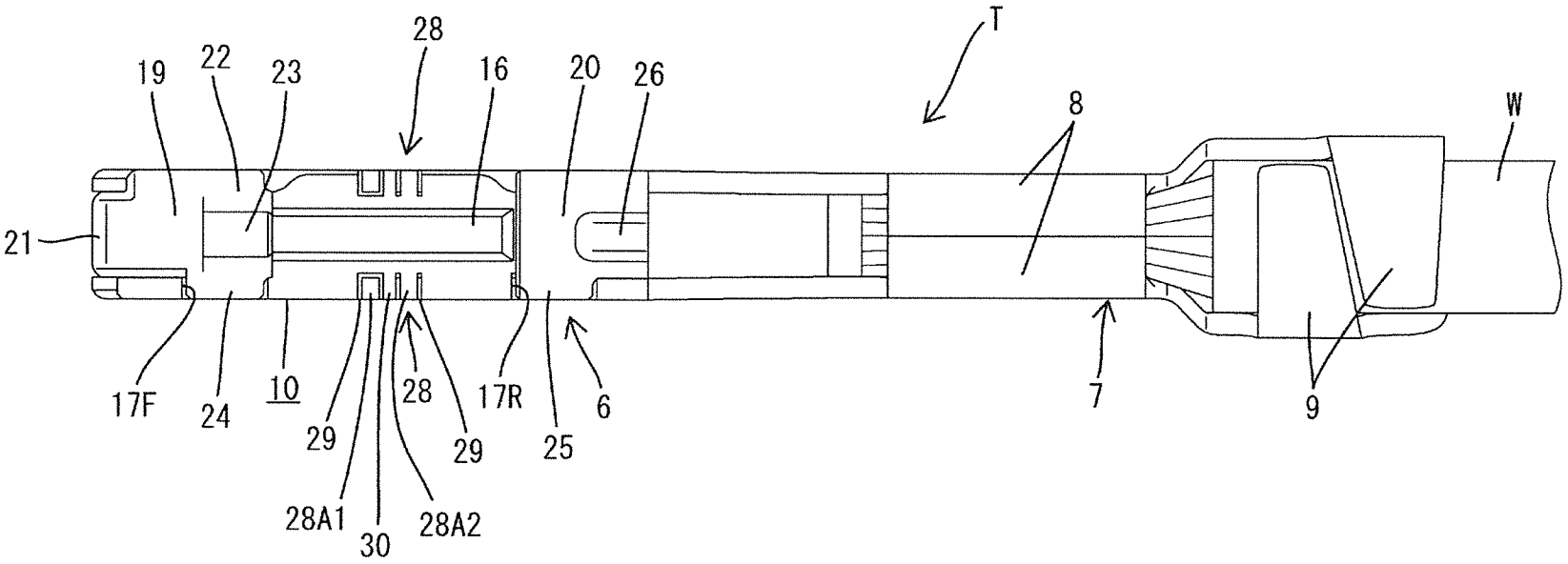
FIG. 2 is a plan view of the terminal fitting.

A ceiling wall 16 extends from a rising end of the right side wall 13R toward the left side wall 13L. Front and rear windows 17F, 17R are open in a corner part from the rising end of the right side wall 13R to the ceiling wall 16. Further, as shown in FIG. 2, a laterally central part of the ceiling wall 16 is recessed inward of the rectangular tube 10 into a groove extending along the front-rear direction. Thus a fixed contact point 18 facing the resilient tongue 14 projects inside the rectangular tube 10. In connecting the male and female terminal fittings, the tab of the male terminal fitting is sandwiched resiliently by the movable contact point 15 and the fixed contact point 18 to establish electrical conduction.

A front covering wall 19 and a rear covering wall 20 divided in the front-rear direction respectively extend horizontally from a rising end of the left side wall 13L toward the right side wall 13R. A front hanging piece 21 is bent down from the front end of the front covering wall 19, and the front surface thereof is a curved surface.

A front widened portion 22 is cantilevered behind a cut formed in the lateral direction in a rear part of the front covering wall 19. A lance locking portion 23 doubling as a stabilizer for preventing inverted insertion of the terminal fitting T projects up in a laterally central part of the front widened portion 22. The lance locking portion 23 is lockable to an unillustrated locking lance deflectably formed in each cavity 4. The lance locking portion 23 is curved and formed to be substantially U-shaped in a front view. The lance locking portion 23 is disposed in a central part with respect to a lateral direction of the rectangular tube 10. Both front and rear end surfaces of the lance locking portion 23 are vertically upright.

Further, a front displacement preventing piece 24 is formed on a free end side of the front widened portion 22. This front displacement preventing piece 24 is fit into the front window 17F, so the front and rear end surfaces thereof face front and rear opening edges of the front window 17F with almost no clearance therebetween.

On the other hand, a rear displacement preventing piece 25 is formed on a free end of the rear covering wall 20 before a cut formed in the lateral direction. The rear displacement preventing piece 25 is fit into the rear window 17R, so the front and rear end surfaces thereof face front and rear opening edges of the rear window portion 17R with almost no clearance defined therebetween. In this way, the front and rear covering walls 19, 20 are positioned in the front-rear direction by the front and rear displacement preventing pieces 24, 25 to maintain the box shape of the rectangular tube 10.

A retainer locking portion 26 doubling as a stabilizer projects up in a laterally central part behind the cut in the rear covering wall 20. Similar to the lance locking portion 23, the retainer locking portion 26 also is substantially U-shaped in a front view. The retainer locking portion 26 is locked by a retainer (not shown) mounted into the connector housing 1 and doubly locks the terminal fitting T together with the locking lance. The retainer locking portion 26 also is disposed in a central part with respect to the lateral direction of the rectangular tube 10.

The retainer locking portion 26 and the lance locking portion 23 are disposed on the same axis in the front-rear direction and are displaceable along the guide groove 5 provided in the cavity 4.

Oblique insertion restricting portions 27, 28 are disposed on four corners of the rectangular tube 10 for impeding insertion of the terminal fitting T in an inverted orientation and an oblique posture into the cavity 4 10. In the first embodiment, two front oblique insertion restricting portions 27 and two rear oblique insertion restricting portions 28 are disposed at two front and rear positions. The oblique insertion restricting portions 27 are disposed on a front end and on corners from both lateral side parts of the bottom wall 12 to base end parts of both side walls 13R, 13L and are located substantially right below the front displacement preventing piece 24.

Each of the front oblique insertion restricting portions 27 includes front and rear resilient pieces 27A1, 27A2. The front and rear resilient pieces 27A1, 27A2 in each front oblique insertion restricting portion 27 are formed inward of substantially U-shaped slits 29 penetrating through the wall of the rectangular tube 10. At this time, the slits 29 are formed in the lateral direction for perpendicularly intersecting an inserting direction of the terminal fitting T into the cavity 4 and extending directions of substantially U-shaped parts are mutually opposite directions. By cutting the slits 29 in the directions opposite to each other in this way, the front resilient piece 27A1 has a cantilever shape so that the side of the side wall 13R, 13L is a connected base end and the side of the bottom wall 12 is a free end. Conversely, the rear resilient piece 27A2 has a cantilever shape so that the side of the side wall 13R, 13L is a connected base end and the side of the bottom wall 12 is a free end. Thus, both resilient pieces 27A1, 27A2 extend in the lateral direction of the rectangular tube 10, i.e. in the direction perpendicularly intersecting the inserting direction of the terminal fitting T and are deflectable inward and outward of the rectangular tube 10.

Further, a partition wall 30 having both end parts respectively connected to the bottom wall 12 and the side wall 13L, 13R is formed between the resilient pieces 27A1, 27A2 while being supported on both ends. Outer surfaces of the partition wall 30 and the resilient pieces 27A1, 27A2 are substantially flush with a peripheral surface of the oblique insertion restricting portion 27.

Figure 3:
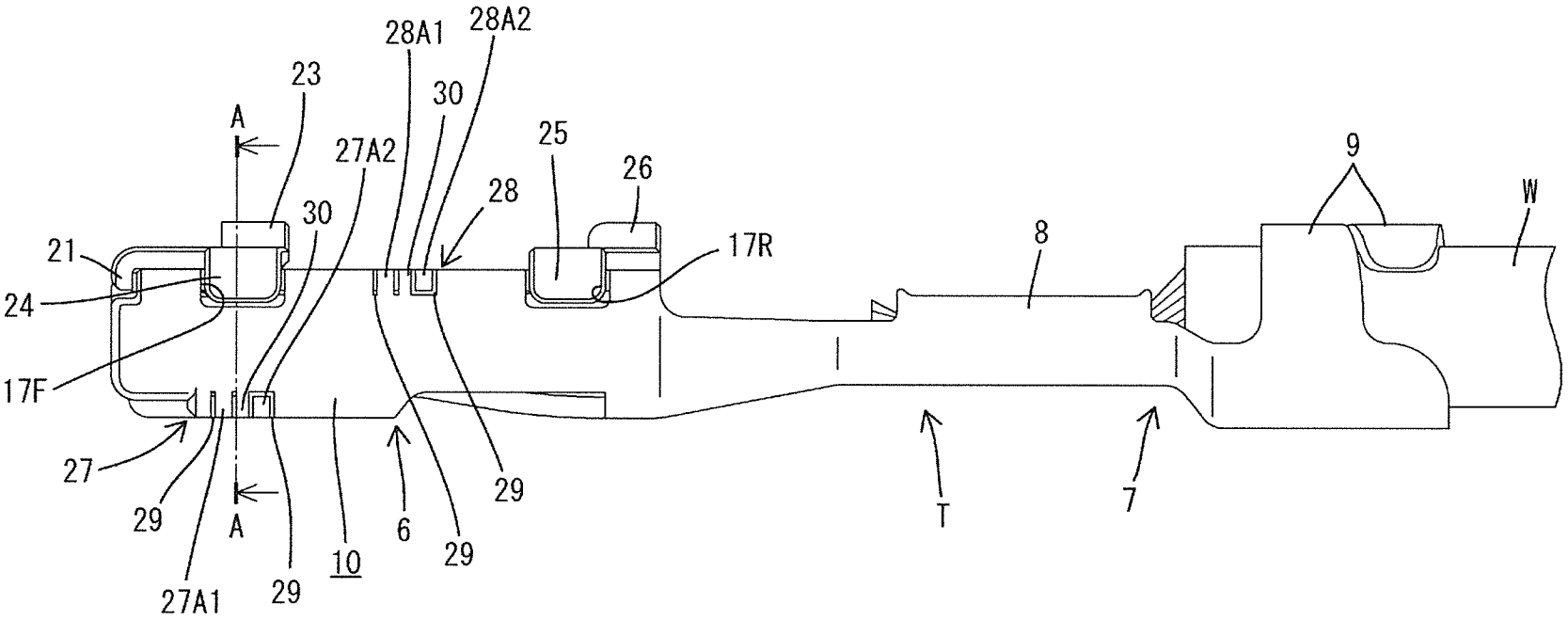
FIG. 3 is a side view of the terminal fitting.

Note that, as shown in FIG. 3, the front end of the resilient piece 27A1 located on the front side in the front oblique insertion restricting portion 27 is located slightly before the front end surface of the lance locking portion 23.

The oblique insertion restricting portions disposed on a rear side (rear oblique insertion restricting portions 28) are disposed on corner parts of an upper surface of the rectangular tube 10 substantially in a center between the front and rear covering walls 19 and 20. Left and right rear oblique insertion restricting portions 28 are formed over ranges from an upper surface side of the ceiling wall 16 of the rectangular tube 10 to side surfaces, and are located substantially on diagonals of the rectangular tube 10 with respect to the front oblique insertion restricting portions 27. Similar to the front oblique insertion restricting portions 27, each rear oblique insertion restricting portion 28 also includes two resilient pieces 28A1, 28A2. The configuration of the rear oblique insertion restricting portions 28 is completely similar to that of the front oblique insertion restricting portions 27, including a feature that extending directions of the resilient pieces 28A1, 28A2 toward free end sides in each rear oblique insertion restricting portion 28 are opposite to each other.

In this way, both the front and rear oblique insertion restricting portions 27, 28 interfere with the inner wall of the cavity 4, as shown in FIG. 8, if it is attempted to insert the terminal fitting T in an inverted posture and in an oblique posture into the cavity 4.

Next, functions and effects of the first embodiment configured as described above are described. When the terminal fitting T is facing the cavity 4 in a proper posture, the lance locking portion 23 and the retainer locking portion 26, which are front and rear stabilizers, are fit into the guide groove 5 of the cavity 4. Thus, the terminal fitting T is inserted into the cavity 4 by these locking portions 23, 26 being guided by the guide groove 5. At this time, since the outer surfaces of any of the resilient pieces 27A1, 27A2, 28A1 and 28A2 and the partition wall 30 are flush with the peripheral surface of the rectangular tube 10 in the terminal fitting T of the first embodiment, the respective oblique insertion restricting portions 27, 28 do not become resistance at the time of insertion. Thus, the terminal fitting T can be inserted smoothly into the cavity 4.

On the other hand, if the terminal fitting T is facing the cavity 4 in a posture vertically inverted by 180° from the proper posture, a front end part of the rectangular tube 10 partially enters the cavity 4, but a projecting part of the lance locking portion 23 interferes with an entrance part of the cavity 4. As described above, since the front end surface of the lance locking portion 23 is a vertical upright surface, this front end surface is in surface contact with a wall surface of the entrance part of the cavity 4. Thus, a situation where the terminal fitting T is inserted in the inverted posture can be prohibited reliably.

However, if the terminal fitting T is inclined counterclockwise, as shown in FIG. 8, while the front end part of the rectangular tube 10 is inserted shallowly into the cavity 4 in a straight inverted posture, the lance locking portion 23 is located substantially on the diagonal of the cavity 4. Therefore an interference margin of the lance locking portion 23 with the entrance part of the cavity 4 becomes small. Thus, if the terminal fitting T is pushed forcibly, the front oblique insertion restricting portion 27 located on a corner part (upper-left corner part in FIG. 8) of the front part of the rectangular tube 10 already shallowly inserted into the cavity on a side opposite to the lance locking portion 23 is pressed strongly against the inner wall of the cavity 4. As a result, the inner wall having received a pressing force applies a pressure contact force to the front oblique insertion restricting portion 27 by the reaction thereof. In this way, a material M of the inner wall of the cavity 4 deflects and deforms the resilient pieces 27A1, 27A2 inward, causing the material M to bite into the front oblique insertion restricting portion 27. If it is attempted to push the terminal fitting T farther in this state, the material having bitten into the front oblique insertion restricting portion 27 is caught to generate large insertion resistance. In this way, a situation where the terminal fitting T is inserted in an improper posture into the cavity 4 is avoided.

The left and right front oblique insertion restricting portions 27 are provided in the first embodiment. Thus, the terminal fitting T can also deal with the case where the terminal fitting T is inclined in a direction opposite to that shown in FIG. 8. Further, insertion can be restricted more reliably since the front oblique insertion restricting portion 27 includes the resilient pieces 27A1, 27A2, and more material can be caused to bite into the front oblique insertion restricting portion 27, as compared to the case where a slit is merely provided. Furthermore, the rear oblique insertion restricting portions 28 also are provided in this embodiment. Thus, insertion can be restricted at the diagonal positions of the terminal fitting T. This is also effective in restricting oblique insertion of the terminal fitting T in an inverted orientation.

The outer surfaces of the resilient pieces 27A1, 27A2, 28A1 and 28A2 and the partition wall 30 do not project from the peripheral surfaces in the oblique insertion restricting portions 27, 28. Thus, it is also possible to obtain an effect that insertion resistance need not be increased at all during a normal inserting operation. Furthermore, since the resilient pieces extend in the opposite directions in each oblique insertion restricting portion 27, 28, a wide inclination range of the terminal fitting T where either one of the front and rear resilient pieces 27A1, 27A2; 28A1, 28A2 can be sufficiently deflected can be ensured. That is, a range capable of dealing with oblique insertion can be expanded.

Second Embodiment

Figure 9:
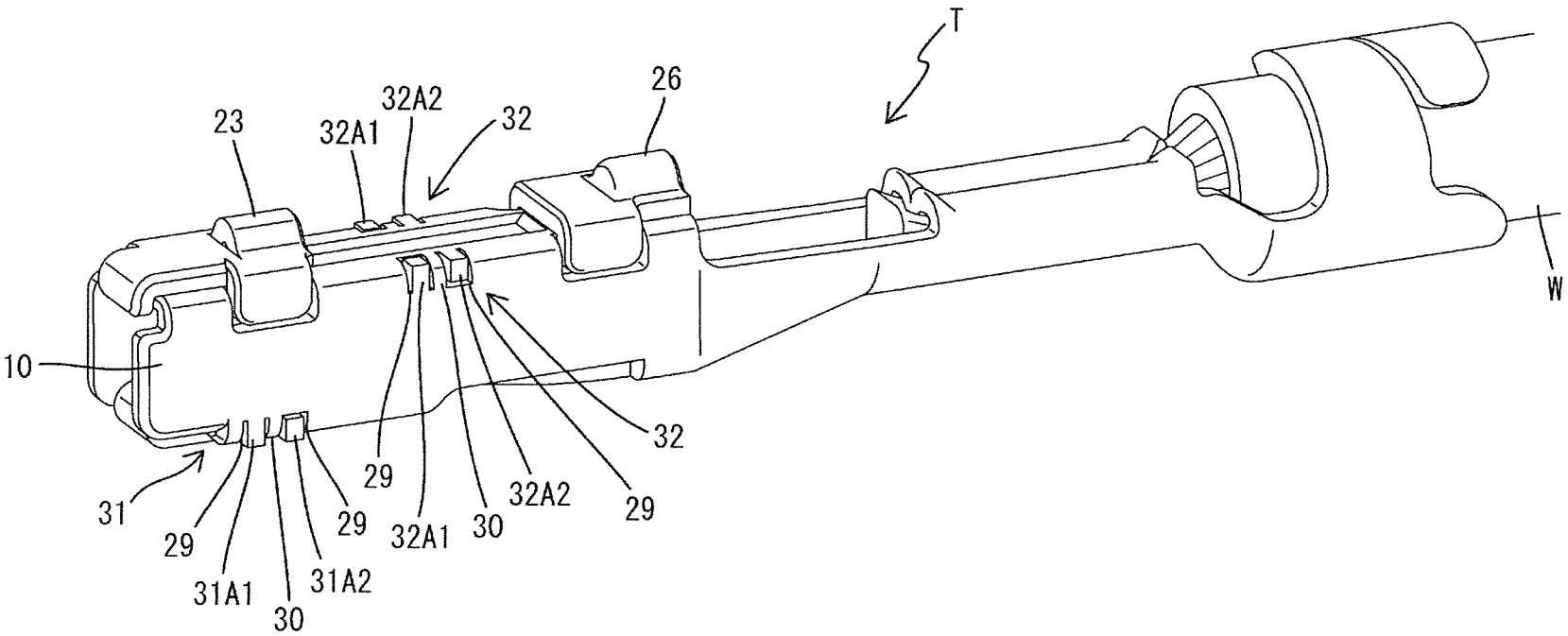
FIG. 9 is a perspective view of a terminal fitting according to a second embodiment.

FIG. 9 shows the second embodiment of the invention. Although the resilient pieces 27A1, 27A2, 28A1 and 28A2 are curved in conformity with curved shapes of the corner parts of the rectangular tube 10 in the first embodiment, resilient pieces extend straight in vertical and lateral directions from a wall surface constituting a rectangular tube 10 in oblique insertion restricting portions 31, 32 in the second embodiment. As in the first embodiment, the periphery of each resilient piece 31A1, 31A2, 32A1, 32A2 is a cantilever by forming a slit 29, and is deflectable and deformable, although only to a slight extent. Further, unlike the first embodiment, the resilient pieces 31A1, 31A2, 32A1 and 32A are formed such that tip sides partially project from the periphery of the rectangular tube 10.

The other configuration is similar to the first embodiment. Hence, similar functions and effects can be achieved.

The invention is not limited to the above described and illustrated embodiments. For example, the following embodiments also are included in the scope of the invention.

Although the oblique insertion restricting portion is provided with the resilient pieces in the above embodiments, the oblique insertion restricting portion may be provided with a slit merely extending in the lateral direction.

Although the oblique insertion restricting portion is formed by forming the substantially U-shaped slits in the above embodiments, a recessed groove such as a knurled groove may be formed in the corner part of the rectangular tube portion 10. In short, it is sufficient to form convex and concave parts intersecting the inserting direction of the terminal fitting T.

Although the invention is applied to the female terminal fitting T in the above embodiments, application to male terminal fittings is also possible.

Although the lance locking 23 and the retainer locking portion 26 project while having a substantially U shape in the above embodiments, the lance locking portions 23 and the retainer locking portion 26 may have other shapes. For example, the rectangular tube 10 may be provided with a locking hole to be locked by the locking lance or the retainer may be locked to the rear end surface of the rectangular tube 10 instead of the retainer locking portion 26.

LIST OF REFERENCE SIGNS

1 . . . connector housing
4 . . . cavity
10 . . . rectangular tube
23 . . . lance locking portion (stabilizer)
26 . . . retainer locking portion (stabilizer)
27, 31 . . . front oblique insertion restricting portion
28, 32 . . . rear oblique insertion restricting portion
T . . . terminal fitting
27A1, 27A2, 31A1, 31A2 . . . resilient piece in front oblique insertion restricting portion
28A1, 28A2, 32A1, 32A2 . . . resilient piece in rear oblique insertion restricting portion

The invention claimed is:

1. A terminal fitting, comprising:

a rectangular tube; and a stabilizer for preventing inverted insertion projecting on an outer surface of the rectangular tube, insertion into a cavity formed in a connector housing being allowed when the terminal fitting is facing the cavity in a proper posture while being prohibited by the stabilizer interfering with the connector housing when the terminal fitting is facing the cavity in a posture inverted from the proper posture;

wherein an oblique insertion restricting portion provided on a corner part of the rectangular tube and recessed while extending in a direction intersecting an inserting direction of the terminal fitting into the connector housing and configured for restricting the insertion of the rectangular tube by a material of an inner wall of the cavity biting into the oblique insertion restricting portion when the terminal fitting is inserted into the cavity in an orientation inverted from the proper posture and in an oblique posture.

2. The terminal fitting of claim 1, wherein the oblique insertion restricting portion is disposed on the corner part located on at least one diagonal position of the rectangular tube.

3. The terminal fitting of claim 1, wherein the oblique insertion restricting portions are disposed on corner parts on both widthwise sides in the rectangular tube.

4. The terminal fitting of claim 1, wherein the oblique insertion restricting portion includes a resilient piece cantilevered in a direction intersecting the inserting direction of the terminal fitting and deflectable inward of the rectangular tube by forming a substantially U-shaped slit penetrating through a wall of the rectangular tube.

5. The terminal fitting of claim 4, wherein the oblique insertion restricting portion includes a plurality of the resilient pieces along the inserting direction, and extending directions of the resilient pieces adjacent in the inserting direction are mutually opposite directions.

6. The terminal fitting of claim 1, wherein an outer surface of the oblique insertion restricting portion and an outer surface of the rectangular tube around the oblique insertion restricting portion are substantially flush with each other.

* * * * *